United States Patent [19]

Ikeya

[11] 4,074,524

[45] Feb. 21, 1978

[54] MANIFOLD REACTOR

[75] Inventor: Taro Ikeya, Toyota, Japan

[73] Assignee: Toyota Jidosha Kogyo Kabushiki Kaisha, Japan

[21] Appl. No.: 683,226

[22] Filed: May 4, 1976

[30] Foreign Application Priority Data

Feb. 18, 1976 Japan ..... 51-16856

[51] Int. Cl.[2] ..... F01N 3/10

[52] U.S. Cl. ..... 60/282; 60/322

[58] Field of Search ..... 60/282, 322

[56] References Cited

U.S. PATENT DOCUMENTS

| | | | |
|---|---|---|---|
| 1,110,040 | 9/1914 | Chatain | 60/322 |
| 2,688,501 | 9/1954 | MacLeod | 60/322 |
| 3,177,649 | 4/1965 | Tromel | 60/322 |
| 3,653,205 | 4/1972 | Tadokoro | 60/322 |
| 3,916,850 | 11/1975 | Date | 60/322 |
| 3,940,927 | 3/1976 | Maurhoff | 60/322 |
| 3,990,856 | 11/1976 | Suzuki | 60/322 |

*Primary Examiner*—Douglas Hart

*Attorney, Agent, or Firm*—Birch, Stewart, Kolasch & Birch

[57] ABSTRACT

A manifold reactor having inner and outer cores, the latter enclosing the former, the outer core having an inlet tube while the inner core having a tubular inlet portion, the inlet tube and the inlet portion being telescoped with each other, wherein an annular seal element made of a metal sheet or sheets is provided between telescoping portions of the abovementioned two members, with one peripheral portion of the annular seal element being connected to one of the two telescoping members, while the other peripheral portion of the annular seal element being elastically and slidably engaged with the other of the two telescoping members.

2 Claims, 1 Drawing Figure

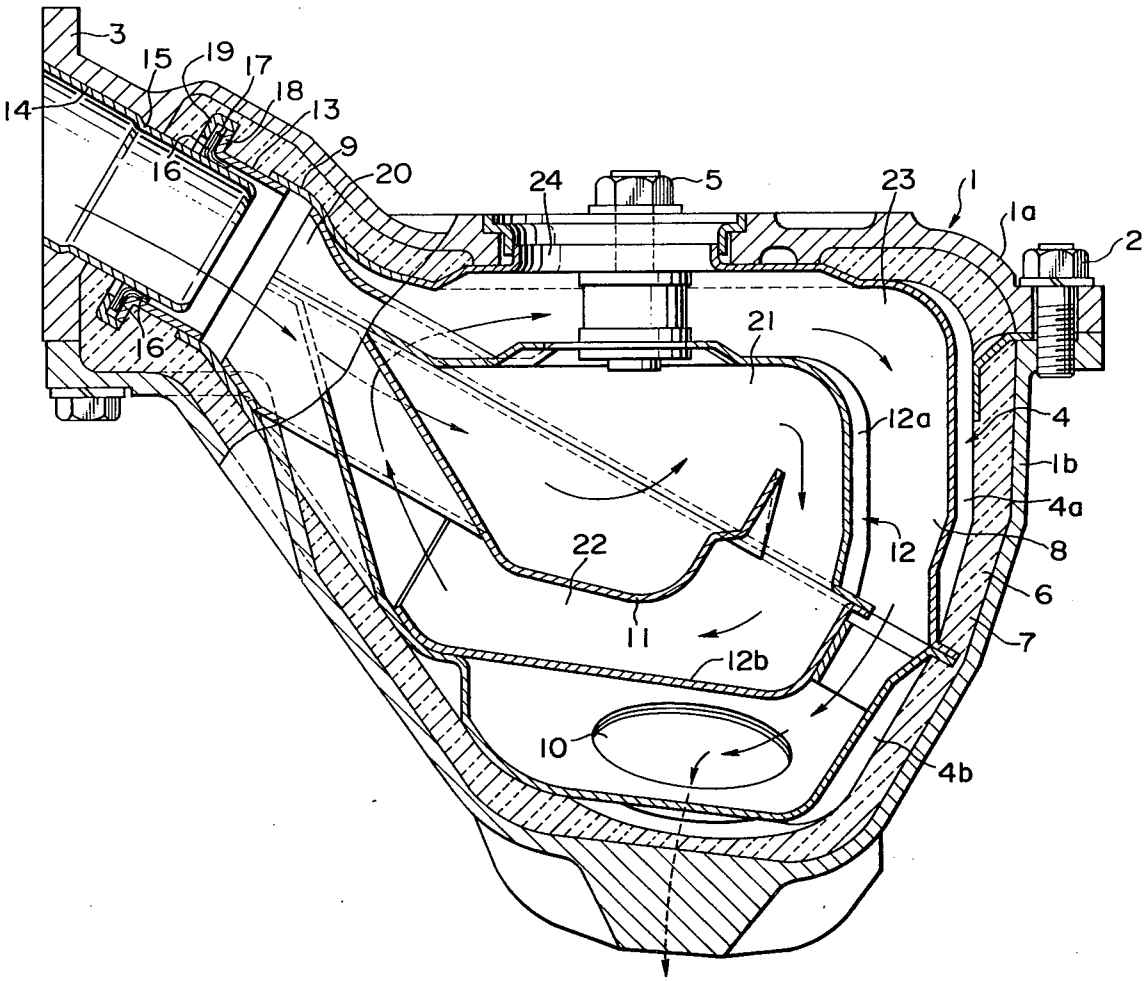
2
1a
1
23
5
24
20
9
13
18
17
19
15
3
14
16
16
21
22
11
12b
10
12a
12
4
1b
4a
8
6
7
4b

MANIFOLD REACTOR

BACKGROUND OF THE INVENTION

1. Field of the Invention

The present invention relates to a manifold reactor mounted in an internal combustion engine for purifying exhaust gases and, more particularly, a seal structure for connecting portions of the outer and inner cores at an exhaust gas inlet port in a multi-walled manifold reactor including the outer and inner cores.

2. Description of the Prior Art

The manifold reactor is a device for purifying exhaust gases from an internal combustion engine by recombusting harmful unburned components such as HC and CO contained in the exhaust gases by utilizing the heat owned by the exhaust gases themselves thereby effecting high temperature oxidization in a reactor chamber. Since the reactor chamber is provided directly adjacent the exhaust ports of the engine thus eliminating the conventional exhaust manifold so as to maintain the temperature in the reactor chamber as high as possible.

Manifold reactors are generally designed as a dual or tripple walled structure including an outer core, inner core or the like in order to provide better heat insulation for the reactor chamber so that the high temperature oxidization to take place in the reactor chamber is effected more efficiently and to provide a sufficiently long dwell time for the exhaust gases in the reactor chamber to accomplish required recombustion thereof. In conventional manifold reactors of this type, the space defined between the inner and outer cores are generally filled with a solid heat insulating material such as glass wool or the like. In this type of manifold reactor, the outer core generally has an inlet tube mounted at its exhaust gas inlet portion while the inner core has a tubular portion for introducing exhaust gases therein, said inlet tube and said tubular portion being telescoped with each other to form a connecting portion which communicates with inlet port defined by said inlet tube to the interior of the combustion chamber defined by the inner core. In this case, the telescoping connecting portions must be loosely engaged with each other so as to allow for different radial thermal expansion of said inlet tube and said tubular introductory portion of the inner core. A clearance required for this release of different thermal expansion requires a radially yieldable seal structure because, otherwise, chips or flocks of the solid heat insulating material filling the heat insulating intermediate space will enter into the reactor chamber or the exhaust system, thus causing a danger of possibly damaging a catalytic converter.

Conventionally, the seal structure employed in this connecting portion comprises a metal flange element mounted around the downstream end of the inlet tube. A similar metal flange element is mounted around the upstream end of the tubular inlet portion of the inner core. Said latter flange element being attached with an annular element having an L-shaped cross section by welding or similar joining means thereby providing an annular channel provided at the leading end of said tubular inlet portion of the inner core so that the annular flange element mounted at the downstream end of the inlet tube is received in an annular channel provided by said annular channel member in a manner such that it is sandwiched between said second mentioned annular flange element and said annular member of L-shaped cross section, thus allowing for a relative displacement of the engaging members in the radial directions.

However, in this conventional sealing structure, since the sealing performance is obtained by the contact of metal flange surfaces, a relatively high accuracy working and assembly are required in order to obtain a desired sealing performance. Furthermore, since these sealing portions are subject to relatively severe thermal expansion and contraction in succession as well as high temperature errosion, even when the seal structure has been manufactured in a sufficiently high accuracy to provide a desired sealing performance in an initial stage of operation, the sealing performance is not maintained for a long period during operation, thus rapidly deteriorating the sealing performance. If the sealing performance lowers, chips and flocks of the solid heat insulating material traverses through the sealing portion toward the inside of the inner core due to the vacuum generated at the exhaust gas inlet portion of the manifold reactor caused by pulsating flow of exhaust gases, thus chips and flocks enter the engine cylinders with the result that piston rings are rapidly worn and, at worst, the engine is broken.

SUMMARY OF THE INVENTION

It is the object of the present invention to solve the abovementioned problems with regard to the seal structure at the exhaust gas inlet portion of the manifold reactor and to provide a manifold reactor having an improved seal structure which is reliable to provide a positive sealing performance for a long period of operation.

According to the present invention, the abovementioned object is accomplished by a manifold reactor comprising an inner core, and an outer core which encloses said inner core therein. Said outer core having an inlet tube mounted therein, said inner core having a tubular portion for introducing exhaust gases therein, said inlet tube and said tubular portion being telescoped within each other and an annular seal element made of a metal sheet or sheets to include two peripheral portions and mounted between telescoped portions of said inlet tube and said tubular portion. One of said two peripheral portions of said annular seal element being connected with one of said two telescoping members in a manner of being axially unmovable relative to each other while the other peripheral portion of said annular seal element is slidably engaged with a peripheral wall of the other of said two telescoping members.

According to the abovementioned structure, said other peripheral portion of said annular seal element which has said one peripheral portion connected with either said inlet tube or said tubular inlet portion of the inner core so as to be axially unmovable relative to each other, slidably engages a cooperating peripheral wall of the other telescoping member under an actuation of an elastic urging force provided by the metal sheet seal element thereby ensuring a good sealing performance between the inside and outside of the inner core. Therefore, a more reliable excellent sealing performance is obtained by the present invention when compared with the aforementioned conventional metal flange seal structure. Furthermore, the seal structure of the present invention does not require such a high accuracy in the working and assembly thereof as required in the conventional seal structure and a relatively rough working and assembly can provide a high degree of reliability in the seal structure. In the present seal structure, a difference in the thermal expansion of the inlet tube and the tubular inlet portion of the inner core is accommodated by the seal element made of a metal sheet or sheets sliding over the associated member while maintaining the sealing performance by effecting an elastic deformation thereof. The seal element may preferably be made of a heat resistive and properly elastic metal sheet material such as, for example, a stainless steel sheet. Furthermore, the seal element may be made of a stack of a plurality of annular metal sheet elements as this structure provides a higher elasticity while maintaining solidness of the element as a whole when compared with a single metal sheet element. Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The accompanying drawing shows a section of an embodiment of the manifold reactor according to the present invention which is given by way of illustration only, and thus is not limitative of the present invention.

DESCRIPTION OF THE PREFERRED EMBODIMENT

Turning now to the drawing, 1 generally designates an outer core which is made of an upper member 1*a* and a lower member 1*b* joined together at their flange portions by bolt-nut means 2, said outer core further being formed with a flange portion 3 for mounting same to a side wall of a cylinder head of an internal combustion engine (not shown). Within the other core 1 is provided an inner core 4 formed to include an upper member 4*a* and a lower member 4*b* joined together at flange portions thereof by welding or other suitable connecting means. The inner core 4 is suspended from the outer core 1 by means of a suspension bolt-nut means 5 while defining a heat insulating space 6 therebetween. The heat insulating space 6, is the particular embodiment shown in the drawing, is charged with a layer of solid heat insulating material 7 such as glass wool or similar material. The inner core 4 defines a reactor chamber 8 therein and comprises a tubular portion 9 for introducing exhaust gases therein at one end portion thereof and an exhaust gas outlet port 10 at the other end portion thereof, said outlet port is connected to an end of an exhaust pipe (not shown) which penetrates a bottom portion of the outer core 1 with said one end projecting inwardly from said bottom portion. Within the reactor chamber 8 there are provided an internal deflecting means 11 and an intermediate deflecting means 12, the latter being made of an upper member 12*a* and a lower member 12*b* joined together at flange portions thereof by welding or other suitable connecting means. The intermediate deflecting means 12 is also suspended by said suspension bolt-nut means 5.

In the particular embodiment shown in the drawing, a connecting tube 13 is connected to the inlet end portion of the tubular exhaust gas introducing portion 9 of the inner core by welding or other suitable connecting means. Similarly, an inlet tube 15 is mounted in an exhaust gas inlet portion 14 formed in the outer core 1, adjacent the flange portion 3 thereof by welding or other suitable connecting means, said inlet tube 15 extending inwardly into the connecting tube 13 for a predetermined length in a loosely telescoping fashion. The connecting tube 13 is formed with a flange portion 18 to which is connected an annular member 19 of an L-shaped cross section thereby forming an annular channel which receives and holds an outer peripheral portion of an annular sealing element 16 made of a stack of a plurality of annular metal sheets such as stainless steel sheet. The inner diameter of said sealing element 16 or each annular metal sheet forming said stack is dimensioned to be a little smaller than the outer diameter of the inlet tube 15. Therefore, when the inlet tube 14 is finally inserted into its assembled position after the assembly is completed of the inner core and the other inside deflecting elements in the upper member 1*a*, the inlet pipe 14 is forced through the central opening of the annular seal element 17 while spreading and flanging the inner peripheral portion of the annular seal element which is slidably engaged around the outer peripheral surface of the inlet tube 14. The flanged portion being elastically urged onto said peripheral outer surface by the restoring force of the seal element itself. Thus, a gas tight seal between the reactor chamber 8 and the heat insulating space 6 is attained. The inlet tube 14 may thereafter be positively mounted to the upper member 1*a* by welding or other suitable connecting means.

In a sealing structure of the abovementioned construction, even when the connecting tube 13 and the inlet tube 15 have deformed relative to each other in an axial or radial direction due to thermal expansion or contraction, the seal element 17 maintains contact with the outer peripheral surface of the inlet tube 15 while sliding on said outer peripheral surface or elastically deforming thereby maintaining the initial sealing performance throughout the entire operating thermal condition. The exhaust gases incoming through the inlet tube 15 flow through a passage 20 defined by said internal deflecting means 11 and the upper deflecting member 12*a* into a first chamber 21 defined by said two members as illustrated in the drawing by arrowed flow lines, wherefrom the gases enter into a second chamber 22 defined by the internal deflecting means 11 and a lower deflecting member 12*b* and then to a third chamber 23 defined by said intermediate deflecting means 12 and the inner core 4 until they finally reach the outlet port 10 so as to be exhausted therefrom through the aforementioned exhaust pipe not shown in the drawing. Therefore, the exhaust gases introduced into the reactor chamber 8 are circulated in said chamber by means of said deflecting elements so that they stay in the reactor chamber for a sufficient time to accomplish high temperature oxidization before they reach the outlet port 10. During this circulation, uncombusted components such as HC and CO included in the exhaust gases are recombusted under a high temperature and, at the same time, a portion of the exhaust gases flows upward from said third chamber 23 through an opening 24 formed at an upper portion of the outer core so as to reach and contact the bottom of a riser portion of an intake manifold (not shown) thereby heating the riser portion.

Although in the shown embodiment the annular seal element is firmly connected at its outer peripheral portion to the connecting tube while the inner peripheral portion thereof is slidably engaged onto the outer peripheral surface of the inlet tube, this construction may be reversed so that the seal element is firmly connected to the inlet tube at its inner peripheral portion while the outer peripheral portion thereof is slidably engaged onto the inner peripheral surface of the connecting tube. Similarly, the present invention is also applicable to an embodiment wherein the tubular exhaust gas introducing portion of the inner core is telescoped into the inlet tube.

Thus, although the invention has been shown and described with respect to a preferred embodiment thereof, it should be understood by those skilled in the art that various changes and omissions in the form and detail thereof may be made therein without departing from the spirit and the scope of the invention.

I claim:

1. A manifold reactor comprising:

an inner core;

an outer core which encloses said inner core therein;

said outer core having an inlet tube mounted therein;

said inner core having a tubular portion for introducing exhaust gases therein;

said tubular portion having a flanged inlet end;

said inlet tube being telescopically received by said tubular portion;

an annular elastic seal element made of a stack of a plurality of annular heat resistant elastic metal sheets and having an L-shaped cross section defined by a flange portion and a tubular portion;

said flange portion of said annular seal element being connected to said flanged inlet end of said inner core tubular portion in a manner such that a relative axial movement between said annular seal element and said inner core tubular portion is prevented while said tubular portion of said annular seal element is received between said inner core tubular portion and said inlet tube; and said annular seal element being slidably engaged on a peripheral surface of said inlet tube.

2. The manifold reactor of claim 1, wherein an annular element having an L-shaped cross section is attached to said flanged inlet end of said inner core tubular portion so as to define an annular chanel in which said flange portion of said annular seal element is received.

* * * * *